US008777588B2

(12) United States Patent
Rentschler et al.

(10) Patent No.: US 8,777,588 B2
(45) Date of Patent: Jul. 15, 2014

(54) FLOW-OPTIMIZED CYLINDER DRUM FOR HYDROSTATIC PISTON ENGINES

(75) Inventors: Joachim Rentschler, Bondorf (DE); Peter Schlotter, Horb-Dettensee (DE)

(73) Assignee: Robert Bosch GmbH, Stuttgart (DE)

( * ) Notice: Subject to any disclaimer, the term of this patent is extended or adjusted under 35 U.S.C. 154(b) by 996 days.

(21) Appl. No.: 12/918,922

(22) PCT Filed: Apr. 8, 2009

(86) PCT No.: PCT/EP2009/002604

§ 371 (c)(1), (2), (4) Date: Aug. 23, 2010

(87) PCT Pub. No.: WO2009/124745

PCT Pub. Date: Oct. 15, 2009

(65) Prior Publication Data

US 2011/0030644 A1 Feb. 10, 2011

(30) Foreign Application Priority Data

Apr. 11, 2008 (DE) ..... 10 2008 018 384

(51) Int. Cl.
*F04B 1/20* (2006.01)
*F04B 1/12* (2006.01)

(52) U.S. Cl.
CPC ..... *F04B 1/2021* (2013.01); *F04B 1/2035* (2013.01); *F04B 1/20* (2013.01)
USPC ..... 417/271; 417/269; 91/505; 91/506; 91/499; 92/12.2

(58) Field of Classification Search
CPC ..... F04B 1/2021
USPC ..... 417/269, 271; 91/505, 506, 499; 92/57, 92/12.2
See application file for complete search history.

(56) References Cited

U.S. PATENT DOCUMENTS

| | | | | |
|---|---|---|---|---|
| 3,739,692 | A * | 6/1973 | Bell | 91/506 |
| 3,868,889 | A * | 3/1975 | Bobier | 91/506 |
| 4,117,770 | A * | 10/1978 | Koshelenko et al. | 92/57 |
| 5,829,960 | A * | 11/1998 | Dreiman | 418/63 |
| 6,406,271 | B1 * | 6/2002 | Valentin | 417/269 |
| 7,380,493 | B2 * | 6/2008 | Park et al. | 92/239 |

FOREIGN PATENT DOCUMENTS

| | | |
|---|---|---|
| DE | 40 35 748 | 5/1991 |
| DE | 43 41 846 | 7/1995 |
| FR | 1 322 953 | 4/1963 |
| GB | 1 023 811 | 3/1966 |
| GB | 1 150 735 | 4/1969 |

* cited by examiner

*Primary Examiner* — Christopher Bobish
(74) *Attorney, Agent, or Firm* — Michael J. Striker

(57) ABSTRACT

The invention relates to a cylinder drum (1') for a hydrostatic piston engine, having at least one kidney-shaped control port/cylinder bore transition (5', 5'', 5''') which leads into a cylinder bore (2, 2'*a*) for receiving a piston that can be axially displaced therein, wherein the kidney-shaped control port/cylinder bore transition (5', 5'', 5''') is configured perpendicular to the flow direction in a stepless and edge-free manner.

9 Claims, 4 Drawing Sheets

FLOW-OPTIMIZED CYLINDER DRUM FOR HYDROSTATIC PISTON ENGINES

CROSS-REFERENCE

The invention described and claimed hereinbelow is also described in PCT/EP2009/002604, filed on Apr. 8, 2009 and DE 10 2008 018 384.9, filed on Apr. 11, 2008. This German Patent Application, whose subject matter is incorporated here by reference, provides the basis for a claim of priority of invention under 35 U.S.C. 119 (a)-(d).

BACKGROUND OF THE INVENTION

The invention relates to a cylinder drum for a hydrostatic piston engine, having at least one kidney-shaped control port/cylinder bore transition which leads into a cylinder bore for receiving a piston that can be axially displaced therein.

Publication DE 43 41 846 C1 makes known a hydrostatic piston engine that includes a cylinder drum in which at least one cylinder bore is formed, in which a piston can be moved upwardly and downwardly. The motion of the piston is controlled by a swash plate against which the piston bears with the aid of a sliding block. The cylinder drum has a contact surface on the end face out of which the piston does not extend; the cylinder drum bears via the aforementioned contact surface against a valve plate. Two kidney-shaped control ports are formed in the valve plate. One kidney-shaped control port is designed as an inlet opening, while the other kidney-shaped control port is designed as an outlet opening. A kidney/cylinder bore transition is formed in the cylinder drum between the cylinder bore and the contact surface on the end face of the cylinder drum out of which the piston does not extend. When the cylinder drum rotates about its rotational axis, the contact surface of the cylinder drum glides across a diametrically opposed contact surface of the valve plate. The kidney/cylinder bore transition alternately connects the cylinder bore to the inlet opening which is connected to a suction connection when a pump is present, and to the outlet opening which is then connected to a pressure connection. When the piston moves downward in the cylinder bore, hydraulic fluid is pumped through the kidney/cylinder bore transition into the cylinder bore. When the piston moves upward, hydraulic fluid is pumped out of the cylinder bore through the kidney/cylinder bore transition out of the cylinder bore. The cylinder drum that was disclosed has the disadvantage that, when the piston moves downward in the cylinder bore, only a relatively small quantity of hydraulic fluid is pumped into the cylinder bore. Therefore, at a given pivot angle of the swash plate per revolution of the cylinder drum, only a relatively small quantity of hydraulic fluid can be pumped from one kidney-shaped control port to the other kidney-shaped control port.

SUMMARY OF THE INVENTION

The object of the invention, therefore, is to create a cylinder drum for hydrostatic piston engines that delivers greater volumetric efficiency.

The cylinder drum, according to the invention, for hydrostatic piston engines has at least one kidney/cylinder bore transition which leads into a cylinder bore for receiving a piston that can be axially displaced therein. The kidney/cylinder bore transition is configured perpendicular to the flow direction in a stepless and edge-free manner. As a result, the flow resistance of the kidney/cylinder bore transition is particularly low. A kidney/cylinder bore transition that has been flow-optimized as a result enables hydraulic fluid or pressure medium to flow through the kidney/cylinder bore transition more rapidly, using less energy, and therefore more favorably. Since less energy is required to transport the pressure medium, the energy efficiency of a hydrostatic piston engine that uses the cylinder drum according to the invention is increased. Transport of pressure medium into and out of the cylinder bore via the flow-optimized kidney/cylinder bore transition is therefore simplified. In this manner, a greater fill level is attained in particular when pressure medium is filled into the cylinder bore e.g. during intake. The volumetric efficiency of the filling process of the cylinder bore or of a hydrostatic piston engine that uses the cylinder drum according to the invention is therefore advantageously increased.

The cylinder drum is preferably sintered. Sintering makes it possible to attain high dimensional stability or e.g. to comply with technical tolerances or tolerances of form e.g. by applying high pressures once more after production.

As a result, it is easy to produce a high quality and a particularly advantageous geometric shape of the flow-optimized kidney-shaped control port/cylinder bore transition. It is therefore possible to omit a material-removing machining method in the region of the transition from the cylinder bores to the inlet/outlet openings.

The geometry of the kidney-shaped control port/cylinder bore transition is preferably selected such that the curvature of the limiting faces is minimal. In particular, there is no flat surface region. The geometry is selected such that a first and a second line of intersection of the kidney-shaped control port/cylinder bore transition with a plane containing the cylinder bore axis have a first radius and a second radius, respectively. The centers of the two radii are formed on different sides of the particular line of intersection, wherein the two radii also transition directly into each other. That is, there is no straight path section of the line of intersection between the two radii, and instead the transition from the first radius into the second radius forms an inflection point of the line of intersection. Particularly preferably, the two radii of a line of intersection are also the same size. In this embodiment, manufacture is simplified due to the minimal curvature of the surfaces, in particular when the cylinder drum is sintered, and flow resistance is reduced.

In the direction toward an end face of the cylinder drum that is oriented in the direction of the control plate, the radius of each line of intersection that is oriented closer to the end face transitions into a tangent at the radius that extends parallel to the cylinder bore axis. The radii therefore start approximately at a distance from the end face of the cylinder drum that bears against the control plate. A straight section of this type improves the flow transition between the opening in the cylinder drum and the kidney-shaped control port of the control plate.

Particularly preferably, the opening in the cylinder drum is likewise kidney-shaped, and therefore a kidney-shaped opening section is formed in the cylinder drum between the cylinder bore and the kidney-shaped control port of the control plate. This kidney-shaped opening section extends along a circumferential circle about the cylinder drum axis, this circumferential circle preferably being identical to the circumferential circle on which the cylinder bores are disposed. In the radial direction, the kidney-shaped opening sections are therefore disposed approximately in the center relative to the cylinder bores. In the circumferential direction of this circumferential circle, the longitudinal extension of the kidney-shaped opening sections is selected such that a straight-line transition is formed here between the opening section and the cylinder bore. The first and second radii are therefore infinite in this region.

Preferably the kidney/cylinder bore transition is composed of a plurality of sections having a different geometry in the axial direction. Each section can be designed in a geometrically advantageous manner to optimize the flow of the kidney/cylinder bore transition. The sections are preferably matched to each other to optimize flow.

Preferably at least one section is designed as a conic section or as an ellipsoid section or especially as a sphere section or as a paraboloid section or a hyperboloid section. Due to the proposed geometric embodiments of the sections, there is a larger number of advantageous designs for sections to optimize flow. By combining a plurality of particularly flow-optimized sections of this type, a particularly flow-optimized kidney/cylinder bore transition having a gradual adaptation of the flow cross-section can be attained. For example, the exact geometric shape of a section and/or the entire kidney/cylinder bore transition can be adapted to the shape of the inlet or outlet opening.

BRIEF DESCRIPTION OF THE DRAWINGS

A preferred embodiment of the cylinder drum, according to the invention, for a hydrostatic piston engine is depicted in the drawing and is described in detail in the description that follows. The figures show.

DETAILED DESCRIPTION OF THE PREFERRED EMBODIMENTS

Figure 1:
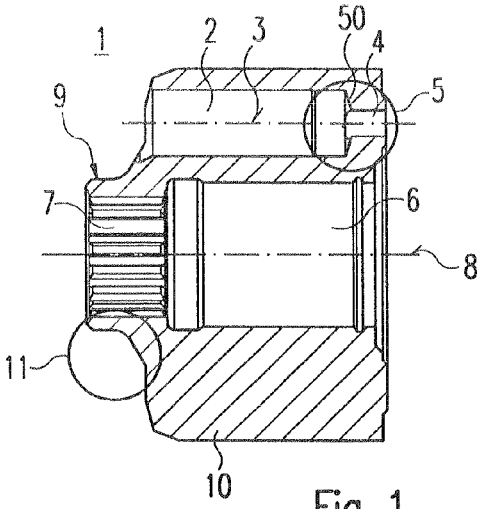
Fig. 1 Prior Art
FIG. 1 a cross section through a cylinder drum according to the prior art.

FIG. 1 shows a cross section through a cylinder drum 1 according to the prior art. Known cylinder drum 1, which is shown, includes a body 10, a neck 9, and a neck/body transition 11 that connects neck 9 to body 10. To receive a not-shown drive shaft, a rotationally symmetrical, central recess 6 is formed in body 10, and a hub 7 is formed in neck 9, which are disposed coaxially and one behind the other along a common cylinder drum axis 8. An opening section 4, which can be kidney-shaped, a second section 50, and a cylinder bore 2 are likewise disposed in body 10, coaxially and in the order indicated, one behind the other along a common cylinder bore axis 3. Cylinder bore axis 3 and cylinder drum axis 8 are situated in parallel.

A kidney/cylinder bore transition 5 connects opening section 4 to cylinder bore 2. The cross section of cylinder bore 2 is greater than that of opening section 4. Cylinder bore 2 is used to receive a piston which is not depicted and is axially displaceble in cylinder bore 2 along cylinder bore axis 3. The piston bears against a sliding block, which is not depicted and, in turn, bears in a gliding manner against a swash plate which is not depicted. When the piston moves axially in cylinder bore 2, depending on the direction of the axial motion of the piston, pressure medium is pumped into or out of cylinder bore 2 through first section 4 and kidney/cylinder bore transition 5. Steps or edges are formed perpendicularly to the flow direction between opening section 4 and second section 50, and between second section 50 and cylinder bore 2. In this description, edges are folds or surface regions having a radius of curvature of zero or at least very close to zero. The steps and edges are produced in the processing of a cast, crude cylinder drum using material-removing machining method.

Known cylinder drum 1 that is shown has the disadvantage that kidney/cylinder bore transition 5 is not flow-optimized. That is, the flow conditions that exist when pressure medium flows through kidney/cylinder bore transition 5 are unfavorable due to its geometric design having steps and edges. Kidney/cylinder bore transition 5 has unfavorable throttle properties due in particular to the steps that extend perpendicularly to the flow direction. In the example shown, due to the steps and edges, an abrupt transition is formed between kidney/cylinder bore transition 5 and cylinder bore 2. A flowing pressure medium cannot spread in such a manner that cylinder bore 2 is filled completely and evenly with pressure medium. A first vacuum volume 14 remains, which is not filled with pressure medium (see FIG. 5). The fill level of cylinder bore 2 is therefore relatively low after the inflow of pressure medium stops. When cylinder bore 2 is emptied, the abrupt transition in kidney/cylinder bore transition 5 poses a particular hurdle to the pressure medium, which results in a throttle resistance of kidney/cylinder bore transition 5. The throttle effect of kidney/cylinder bore transition 5 also results in a corresponding development of heat. In all, therefore, the volumetric efficiency of the filling process of cylinder bore 2 and the energy efficiency of the pressure-medium turnover process can be improved further.

For simplicity, only one cylinder bore 2 and related transition 5 will be explained. Of course, a plurality of systems of this type are distributed around the circumference, along a circumferential circle, in the case of a cylinder drum 1 according to the prior art and in the case of a cylinder drum according to the invention.

Figure 2:
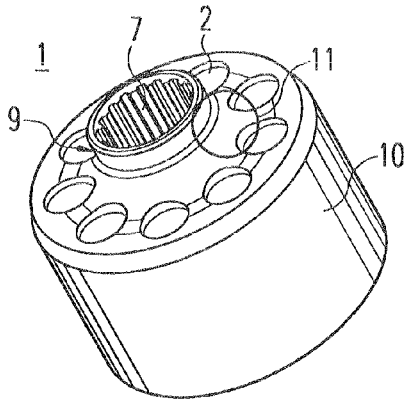
Fig. 2 Prior Art
FIG. 2 a perspective view of a cylinder drum according to the prior art.

FIG. 2 shows a perspective view of a cylinder drum 1 according to the prior art. Cylinder drum 1 that is shown corresponds to known cylinder drum 1 depicted in FIG. 1. FIG. 2 shows body 10, neck 9, hub 7 formed in neck 9, and the outlets in cylinder bore 2 particularly clearly. Neck/body transition 11 is likewise clearly shown.

Figure 3:
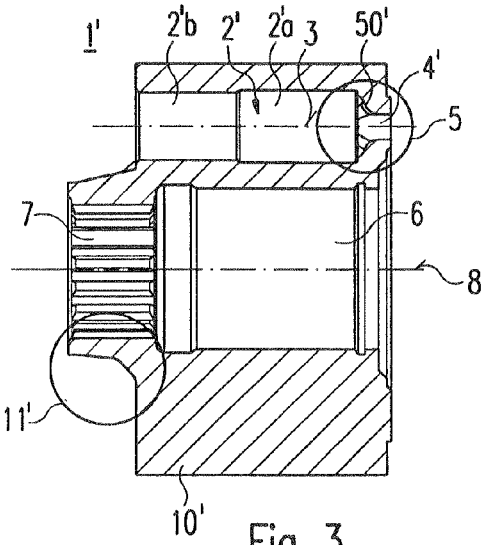
FIG. 3 a cross section through a cylinder drum according to the invention.

FIG. 3 shows a cross section through a cylinder drum 1' according to the invention. Cylinder drum 1' according to the invention basically has the same design as known cylinder drum 1. Cylinder drum 1' according to the invention includes a body 10' according to the invention, and a neck 9 connected to body 10' via an improved neck/body transition 11'. The following are disposed in body 10' according to the invention, coaxially and in the order indicated, along common axis 3: e.g. a kidney-shaped opening section 4, a second section 50' which has been flow-optimized according to the invention, and a cylinder bore 2' that includes a first cylinder bore section 2'*a* and a second cylinder bore section 2'*b*. First and second cylinder bore sections 2'*a* and 2'*b*, respectively, are created using material-removing methods. A high-quality surface is created in the case of second cylinder bore section 2'*b* in particular since it interacts with the piston in a sealing manner. A crude cylinder drum is sintered and then machined in a material-removing manner.

Central, rotationally symmetrical recess 6 and a hub 7 in neck 9 for receiving a drive shaft, which is not shown, are likewise formed in cylinder drum 1' according to the invention; they are disposed coaxially along a common cylinder drum axis 8 which is parallel to cylinder bore axis 3. Cylinder bore 2' is used to receive a piston which is not shown. The piston is axially displaceable in cylinder bore 2' along cylinder bore axis 3. The volume that is available in cylinder bore 2' for receiving pressure medium is varied by the motion of the piston. The piston bears via a sliding block, which is not depicted, against a swash plate which is not depicted. When the piston moves axially in cylinder bore 2', depending on the direction of the axial motion, pressure medium is pumped into or out of cylinder bore 2' through kidney/cylinder bore transition 5', which has been flow-optimized according to the invention. Kidney/cylinder bore transition 5' according to the invention connects kidney-shaped opening section 4 to first cylinder bore section 2'*a* via flow-optimized kidney/cylinder bore transition 5'. Kidney-shaped opening section 4, flow-optimized kidney/cylinder bore transition 5', and first cylinder bore section 2'*a* are disposed coaxially, in this order, along cylinder bore axis 3. Kidney-shaped opening section 4 has a smaller expansion in the radial direction than does first cylinder bore section 2'*a* of cylinder bore 2'. Flow-optimized kidney/cylinder bore transition 5' has the advantage that, due to its geometric design, it ensures favorable flow conditions when pressure medium flows through cylinder bore transition 5'. An abrupt transition is not formed by steps or edges, which would result in vortex formation. The disadvantages explained with reference to cylinder drum 1 therefore do not occur. The improved geometry results in an increased fill level of cylinder bore 2' when pressure medium flows into cylinder bore 2', and in less heat being produced in kidney/cylinder bore transition 5' due to the lower throttle resistance. In this manner, the volumetric efficiency during operation of cylinder bore 1' according to the invention, and the energy efficiency of the pressure-medium throughput process are increased. In all, the overall efficiency of a hydrostatic piston engine that uses cylinder drum 1' according to the invention is increased.

Figure 4:
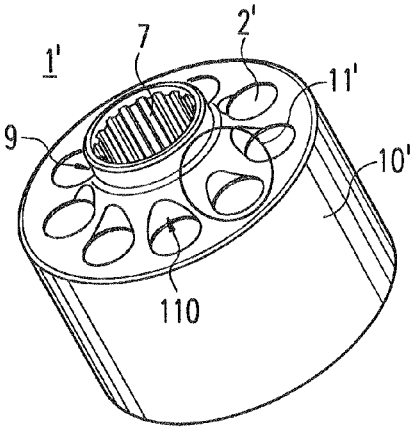
FIG. 4 a perspective view of a cylinder drum according to the invention.

FIG. 4 is a perspective view of a cylinder drum 1' according to the invention. Cylinder drum 1' according to the invention and shown in FIG. 4 corresponds to cylinder drum 1' according to the invention and shown in FIG. 3. FIG. 4 shows body 10' according to the invention, on which neck 9 is formed. A hub 7 is formed in neck 9. An alternative neck/body transition 11' is formed such that a cylinder bore 2' does not extend through it. For this purpose, recesses 110 are formed in alternative neck/body transition 11'.

Via recesses 110, cylinder bores 2' lead into a flat surface that is situated perpendicularly to cylinder bore axis 3. This is explained below with reference to FIG. 9.

Figure 5:
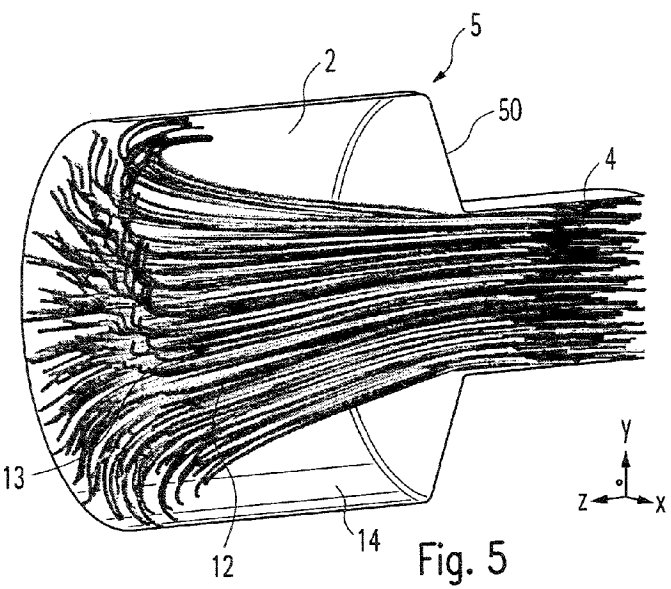
FIG. 5 a cross section through a region of a cylinder drum according to the prior art, including particle trajectories of a filling flow.

FIG. 5 shows a cross section through a region of a cylinder drum 1 according to the prior art, including particle trajectories of a filling flow. The region that is shown corresponds to kidney/cylinder bore transition 5 of known cylinder drum 1. Particle trajectories 12 are used to depict the shape of a first pressure-medium flow 13 of the type that occurs when pressure medium enters cylinder bore 2. Due to the geometric design of opening section 4 and second section 50, or due to the abrupt transition formed by these sections, having edges and steps perpendicular to the direction of flow from first opening section 4 to cylinder bore 2, only a narrow stream of pressure medium forms in first pressure-medium flow 13 when pressure medium enters cylinder bore 2 at the cylinder bore-side end of second section 50. The narrow stream of pressure medium flowing into cylinder bore 2 widens in cylinder bore 2 at higher pressure-medium velocities of the type that occur during normal operation of a hydrostatic piston engine, although slowly. That is, a significant expansion of first pressure-medium flow 13 does not occur until deep in cylinder bore 2. First vacuum volume 14 is produced in cylinder bore 2 as a result. First vacuum volume 14 is also present after pressure medium enters cylinder bore 2. As a result, cylinder bore 2 is only partially filled with pressure medium. The fill level of cylinder bore 2 and the volumetric efficiency of the process of filling cylinder bore 2 are therefore relatively low. The throttle effects that occur in particular due to the steps and edges formed perpendicular to the flow direction were described above with reference to FIG. 1.

Figure 6:
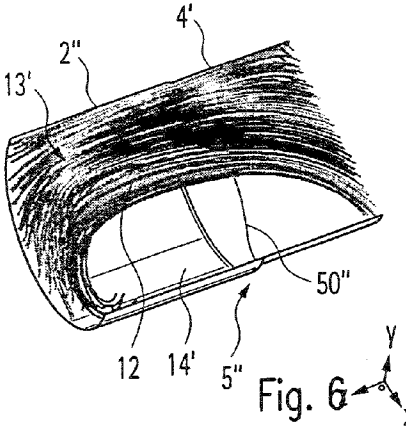
FIG. 6 a cross section through a region of a further cylinder drum according to the prior art, including particle trajectories of a filling flow.

FIG. 6 shows a cross section through a region of a further cylinder drum 1 according to the prior art, including particle trajectories of a filling flow. The region shown includes an opening section 4' that is elongated in the circumferential direction of cylinder drum 2 and is adapted to the geometry of the kidney-shaped control ports in the control plate. A further, non-rotationally symmetrical section 50" connects longitudinal opening section 4' to a cylinder bore 2" in further kidney-shaped control port/cylinder bore transition 5". Due to the geometric shape of elongated opening section 4' and non-rotationally symmetrical, second section 50", the inflowing pressure medium in a second pressure-medium flow 13' is kept narrow and therefore rapid. In this case as well, the pressure-medium stream emerges from the piston, which is not depicted, at a correspondingly high velocity. A significant, second vacuum volume 14' occurs here as well, which results in a low fill level and low volumetric efficiency. In this embodiment of a kidney-shaped control port/cylinder bore transition 5" as well, the throttle effect of further kidney-shaped control port/cylinder bore transition 5" results in high heat development and therefore to low energy efficiency in pressure-medium throughput processes.

Figure 7:
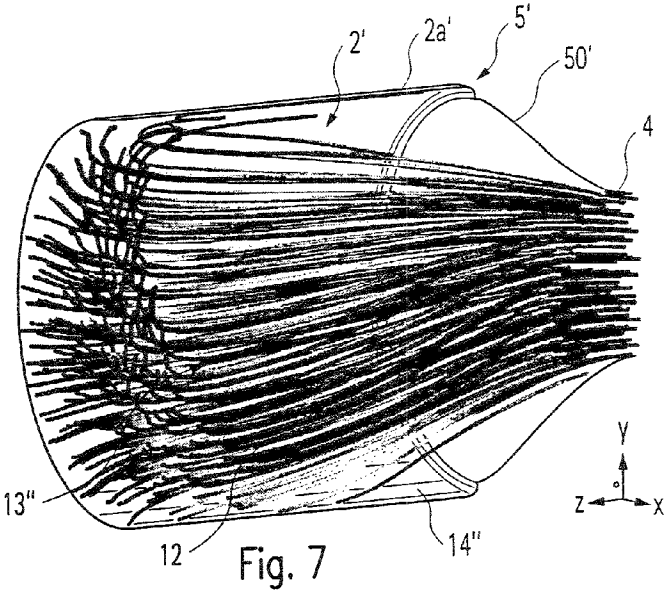
FIG. 7 a cross section through a region of a cylinder drum, including particle trajectories of a filling flow.

FIG. 7 shows a cross section through a region of cylinder drum 1' according to the invention, including particle trajectories of a filling flow. Kidney/cylinder bore transition 5', which is shown, of cylinder drum 1 according to the invention has a flow-optimized design. For this purpose, second section 50' is designed without steps or edges. An optimized, third pressure-medium flow 13" is depicted using particle trajectories 12; pressure-medium flow 13" results when pressure medium enters cylinder bore 2' due to the geometric design of kidney/hollow cylinder transition 5' according to the invention, which is free of steps and edges and has been flow-optimized. Due to the flow-optimized design of second section 50', the pressure-medium stream that emerges from kidney-shaped opening section 4 and enters second section 50', according to the invention, and finally enters cylinder bore 2', can expand more rapidly than in the case depicted in FIG. 5. As a result, only a very small third vacuum volume 14" is produced in cylinder bore 2'. As a result, cylinder bore 2' is filled at least nearly completely with pressure medium. The fill level of cylinder bore 2' is therefore particularly high, and the volumetric efficiency of the process of filling cylinder bore 2' is therefore likewise increased accordingly. Since the stream expands quickly, the pressure-medium velocity also slows in the wide regions of third pressure-medium flow 13". As a result, the pressure-medium stream strikes the piston, which is not depicted, at a lower velocity. The throttle effect of flow-optimized kidney/cylinder bore transition 5' according to the invention is reduced overall and is therefore more favorable. Due to these advantages, heat development and, therefore, energy losses are reduced. Energy efficiency is increased as a result.

Figure 8:
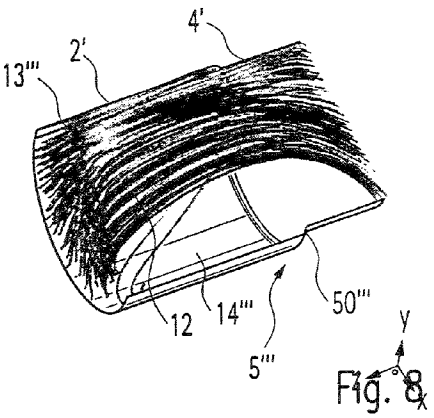
FIG. 8 a cross section through a region of a further cylinder drum according to the invention, including particle trajectories of a filling flow.

FIG. 8 shows a cross section through a region of a further cylinder drum 1' according to the invention, including particle trajectories of a filling flow. The region shown in FIG. 8 includes an elongated opening section 4' and a second, non-rotationally symmetrical section 5" that connects elongated opening section 4' to cylinder bore 2'. Elongated opening section 4' and second, non-rotationally symmetrical section 5" are designed such that the emerging pressure-medium stream expands rapidly in a fourth pressure-medium flow 13'. This results in a slowing of the pressure medium in fourth pressure-medium flow 13'". As a result, the advantages described with reference to FIG. 7 occur in this case as well.

Figure 9:
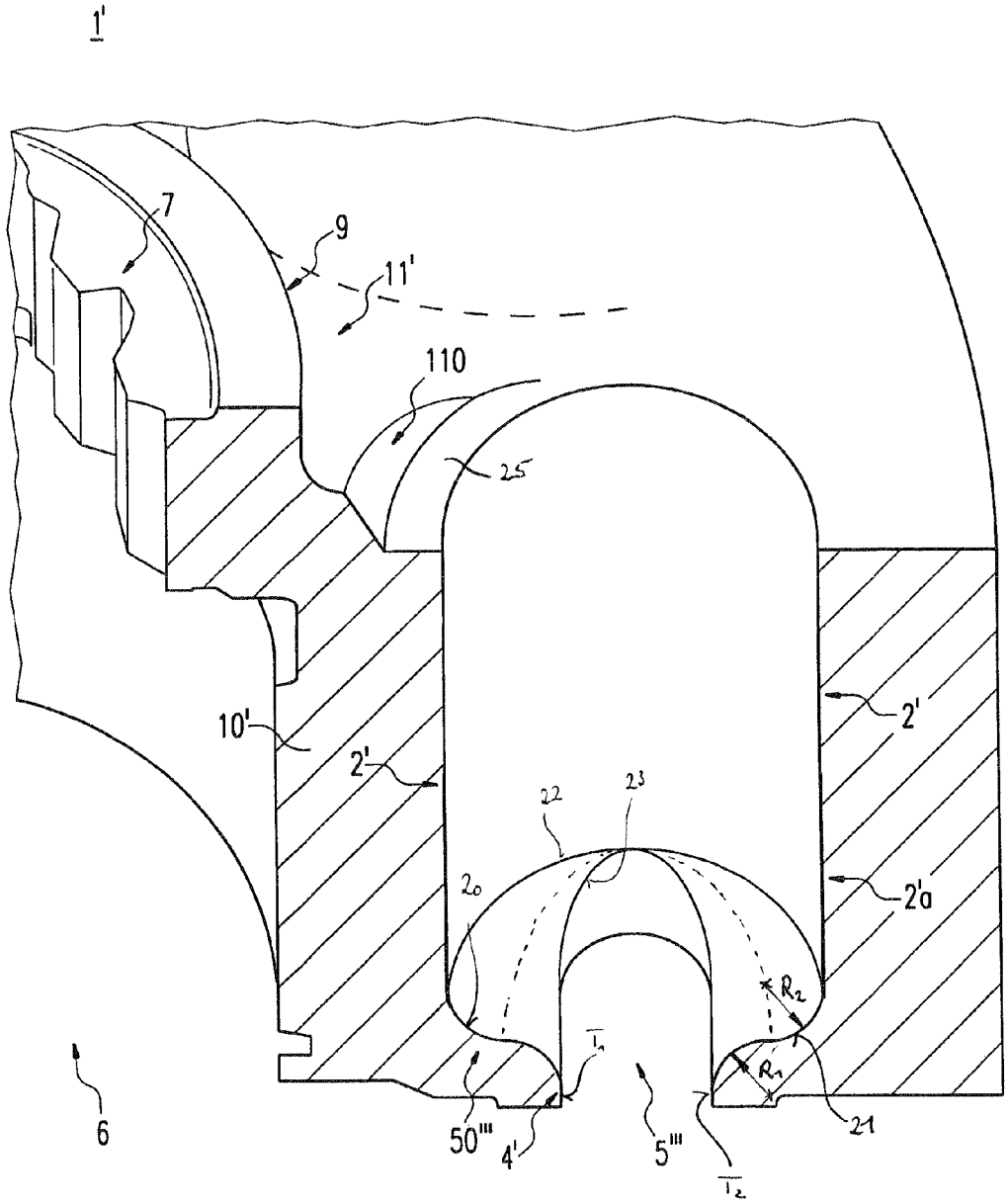
FIG. 9 a further cross section through the region of the further cylinder drum, according to the invention, in a perspective view.

FIG. 9 shows a further cross section through the region of further cylinder drum 1' according to the invention, which is depicted in FIG. 8. The cutting plane extends through cylinder drum axis 8 and through cylinder bore axis 3. Kidney-shaped opening section 4' and second, non-rotationally symmetrical section 5", which connects opening section 4' to cylinder bore 2', are shown particularly clearly. Kidney-shaped opening section 4' forms a stepless and edge-free transition to second, non-rotationally symmetrical section 5'" which, in turn, forms a stepless and edge-free transition to cylinder bore 2'. In the embodiment shown, first cylinder bore section 2'*a* and second cylinder bore section 2'*b* of cylinder bore 2' have approximately the same radius after second cylinder bore section 2'*b* has undergone material-removing machining. Due to the stepless and edge-free transitions, an emerging pressure-medium stream can expand rapidly, thereby resulting in the advantages explained with reference to FIG. 8 and FIG. 7.

Preferably, a kidney/cylinder bore transition according to the invention is composed of one or more sections having different geometries, which are disposed one behind the other in the axial direction relative to cylinder bore axis 3.

Given that, in the case of a cylindrical opening section, individual sections can be designed as a conic section, in particular to connect rounded sections that abut either side, as an ellipsoid section, a paraboloid section, or as hyperboloid section, a large number of advantageously designed sections or series of sections can be attained for flow optimization.

As shown in FIG. 9, at least two sections that are disposed one behind the other in the axial direction are preferably formed, and form, in a sectional view in the longitudinal direction of cylinder bore 2', a first line of intersection 20 and a second line of intersection 21 which form oppositely curved sections of circular arcs. The wall of cylinder bore 2' and the wall of opening section 4' toward the kidney-shaped control ports preferably transition tangentially into these curvatures. First and second lines of intersection 20 and 21 therefore have a tangent $T_1$ and $T_2$, respectively, on their particular radius, which results from the boundary of kidney-shaped opening section 4'. Lines of intersection 20, 21 are formed by cutting cylinder drum 1' with a plane; in the sectional view shown, the plane contains cylinder drum axis 8 and cylinder bore axis 2.

For second line of intersection 21, it is explicitly indicated that it is formed substantially by two circular-arc sections having radii $R_1$ and $R_2$, and which are abutted tangentially by tangent $T_2$ and cylinder bore 2', respectively. The embodiments relate to the crude cylinder drum 1' shown, which is sintered. After material-removing machining, first and second cylinder bore sections 2'*a* and 2'*b*, respectively, are formed in cylinder bore 2', as explained above.

The centers of radii $R_1$ and $R_2$, which transition into each other, of second line of intersection 21 lie on different sides of line of intersection 21. An inflection point of second line of intersection 21 is formed at the point where first radius $R_1$ transitions into second radius $R_2$. Radii $R_1$, $R_2$ are preferably identical in size, as shown in the example, and can be 3 millimeters e.g. for typical geometries of cylinder drums 1'.

Lines 22 and 23 are not edges, and are used only to illustrate the transition of the first radius into kidney-shaped opening section 4' or of the second radius into cylinder bore 2' i.e. the position of the contact points of the tangents to the radii. The position of the inflection point is indicated therebetween using a dashed line.

As explained above, there is no flat plane element in the embodiment shown of the transition from kidney-shaped opening sections 4' into cylinder bores 2'. In particular, the direct transition of the two curvatures having radii $R_1$, $R_2$ makes it possible to form the largest possible radii. If the plane that results in the formation of lines of intersection 20, 21 shown is rotated about cylinder bore axis 3, it is easy to see that radii $R_1$, $R_2$ change. Radii $R_1$, $R_2$ are preferably identical in size in this case as well, however. In the rear region of kidney-shaped opening section 4' shown in FIG. 9, where lines 22 and 23 come in contact with each other, radii $R_1$ and $R_2$ become infinite, thereby resulting in a straight-line transition here from the end of kidney-shaped opening section 4' into cylinder bore 2'.

A flat surface 25 is formed on the end of cylinder bore 2' facing away from kidney-shaped opening section 4'. Flat surface 25 is formed by performing material-removing machining around cylinder bore 2'. Flat surface 25 lies in a plane that extends perpendicularly to the cylinder bore axis. It is used as a contact surface for tools that are used for the further material-removing machining of cylinder bore 2'.

Figure 10:
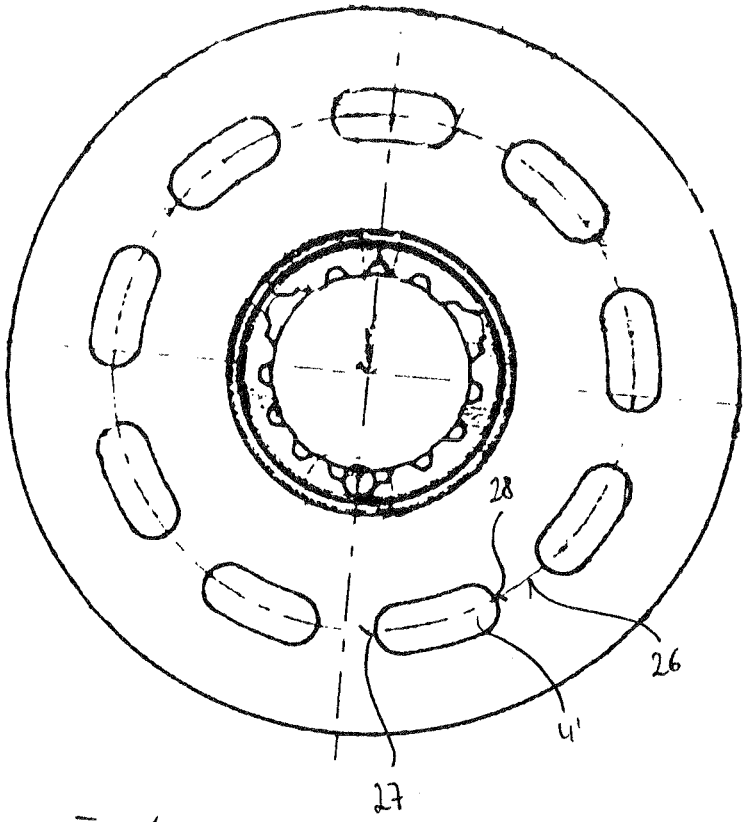
FIG. 10 a view of the end face of the cylinder drum facing a control plate, to illustrate the geometry of the opening sections.

FIG. 10 is used to illustrate the position of kidney-shaped opening sections 4'. For clarity, only a single kidney-shaped opening section 4' is labelled with reference characters. It is shown that kidney-shaped opening sections 4' extend along a circumferential circle 26. Circumferential circle 26 is identical to the circumferential circle on which cylinder bores 2' are disposed. The elongated shape of kidney-shaped opening sections 4' in the circumferential direction results in the non-rotationally symmetric geometry described above, and as shown in FIG. 9. Resulting therefrom are the straight-line transitions in the region of ends 27 and 28. The extension of kidney-shaped opening sections 4' in the radial direction, which corresponds to the width of kidney-shaped opening sections 4', is smaller than the diameter of cylinder bores 2'.

The present invention is not limited to the embodiments shown. Instead, individual features of the embodiments may be advantageously combined with one another.

What is claimed is:

1. A cylinder drum (1') for a hydrostatic piston engine, having at least one kidney-shaped control port/cylinder bore transition (5', 5", 5'") which leads into a cylinder bore (2, 2'*a*) for receiving a piston that can be axially displaced therein, wherein the kidney-shaped control port/cylinder bore transition (5', 5", 5'") is configured perpendicular to the flow direction in a stepless and edge-free manner, wherein a first and a second line of intersection (20, 21) of the kidney-shaped control port/cylinder bore transition (5', 5", 5'") with a plane containing the cylinder bore axis (3) have a first radius ($R_1$) and a second radius ($R_2$), respectively, the centers of which are formed on different sides of the lines of intersection (20, 21), the transition of which forms an inflection point, wherein, adjacent to the radius ($R_1$) which lies closer to the end face of the cylinder drum (1'), the lines of intersection (20,

21) extend as tangents ($T_2$) to the radius ($R_1$), which extend parallel to the cylinder bore axis (3), wherein the tangents ($T_1$, $T_2$) of the lines of intersection (20, 21) are formed by a kidney-shaped opening section, wherein the kidney shaped opening section (4') extends along a circumferential circle (26) about a cylinder drum axis (8), and a length of the opening section (4') in the direction of the circumferential circle (26) is dimensioned such that the radii ($R_1$, $R_2$) are infinite at the ends (27, 28) of the opening section (4').

2. The cylinder bore according to claim 1, wherein that the cylinder drum (1') is sintered.

3. The cylinder drum according to claim 1, wherein the first radius ($R_1$) and the second radius ($R_2$) of a particular line of intersection (20, 21) are the same size.

4. The cylinder drum according to claim 1, wherein the kidney-shaped control port/cylinder bore transition (5', 5'', 5''') is composed of a plurality of sections (4, 4', 50, 50') having different geometries.

5. The cylinder drum according to claim 4, wherein at least one section is designed as a conic section.

6. The cylinder drum according to claim 4, wherein at least one section is designed as a ellipsoid section.

7. The cylinder drum according to claim 4, wherein at least one section is designed as a sphere section.

8. The cylinder drum according to claim 4, wherein at least one section is designed as a paraboloid section.

9. The cylinder drum according to claim 4, wherein at least one section is designed as a hyperboloid section.

* * * * *